US007104628B2

(12) United States Patent
Yamazaki et al.

(10) Patent No.: US 7,104,628 B2
(45) Date of Patent: Sep. 12, 2006

(54) INK JET PRINTER

(75) Inventors: Takeshi Yamazaki, Hachioji (JP); Tetsushi Aoki, Musashimurayama (JP)

(73) Assignee: Konica Minolta Holdings, Inc., Tokyo (JP)

( * ) Notice: Subject to any disclaimer, the term of this patent is extended or adjusted under 35 U.S.C. 154(b) by 268 days.

(21) Appl. No.: 10/863,759

(22) Filed: Jun. 7, 2004

(65) Prior Publication Data

US 2004/0252157 A1 Dec. 16, 2004

(30) Foreign Application Priority Data

Jun. 13, 2003 (JP) ..... 2003-169642

(51) Int. Cl.
*B41J 2/165* (2006.01)

(52) U.S. Cl. ..... 347/29; 347/31

(58) Field of Classification Search ..... 347/22–35
See application file for complete search history.

(56) References Cited

U.S. PATENT DOCUMENTS 5,055,856 A * 10/1991 Tomii et al. ..... 347/30
6,203,136 B1 * 3/2001 Takahashi et al. ..... 347/32
6,471,330 B1 * 10/2002 Umeda et al. ..... 347/29
6,491,369 B1 * 12/2002 Satoh et al. ..... 347/30
6,540,322 B1 * 4/2003 Usui et al. ..... 347/29
6,830,311 B1 * 12/2004 Fukasawa et al. ..... 347/29
6,899,412 B1 * 5/2005 Hirai ..... 347/29

* cited by examiner

*Primary Examiner*—Shih-Wen Hsieh
(74) *Attorney, Agent, or Firm*—Frishauf, Holtz, Goodman & Chick, P.C.

(57) ABSTRACT

An ink jet printer comprises a cap for covering nozzles for jetting ink, wherein the cap has a suction opening and a atmosphere-communicating opening in the neighborhood of its one end portion in the lengthwise direction, and an ink absorption body formed in the cap, wherein the height of the ink absorption body in the area other than the neighborhood of the suction opening is higher than its height in the neighborhood of the suction openings, and carries out a restoration processing through suctioning ink from the nozzles.

20 Claims, 7 Drawing Sheets

FIG. 4 ( a )
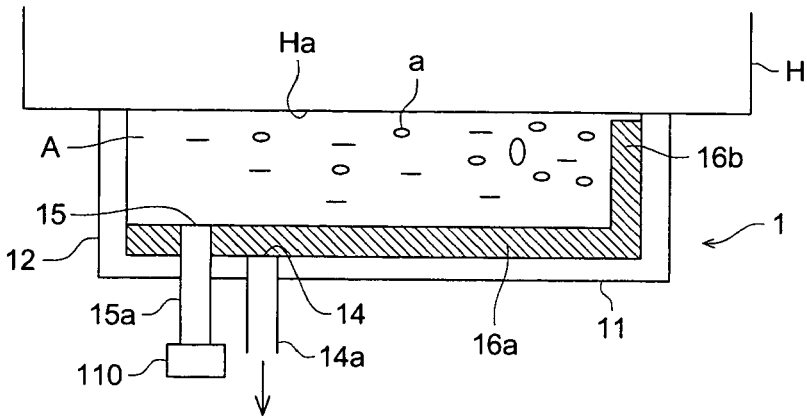
FIG. 4 ( b )
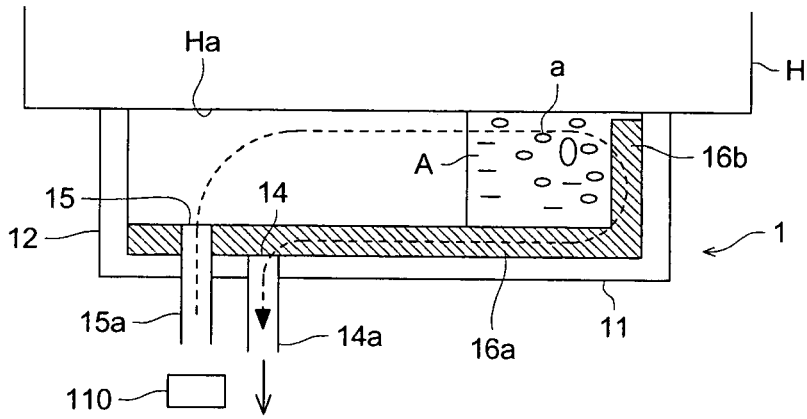
FIG. 4 ( c )
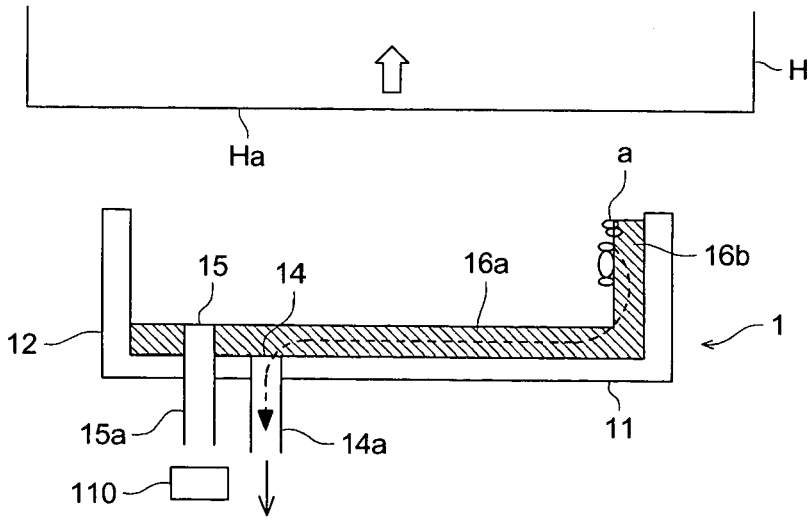

INK JET PRINTER

RELATED APPLICATION

This application is based on patent application No. 2003-169642 filed in Japan, the content of which is hereby incorporated by reference.

BACKGROUND

1. Field of the Invention

This invention relates to an ink jet printer, and in particular, to an ink jet printer which makes a cap for suctioning ink (hereinafter also referred to as a cap simply) provided become closely attached to the nozzle surface of ink, and by making the pressure inside the cap reduced to suction ink from the nozzles, practices a restoration processing.

2. Description of the Related Art

If an ink jet printer is not used for a long period of time, water content vaporizes from its ink nozzles, which raises the viscosity of the ink in the nozzles, and clogging up of the nozzles occurs. If printing is done in such a state, because no ink is jetted from the nozzles clogging up, white streaky unevenness is generated in the output image, to degrade the output image.

In order to avoid such a condition, the nozzle surface is covered with a cap at the time of a maintenance operation, a negative pressure is generated by a suction means such as a pump, and ink is suctioned from each of the nozzles. By doing this, a foreign object or the like is suctioned, and the nozzles are restored to become in the optimum state. By the practice of such a maintenance operation, the quality of print is maintained.

As regards the sequence of the restoration processing at this time, a failure of jetting owing to the clogging up of the nozzles is restored through the processes of "suction" (The cap is made to be closely attached to the nozzle surface, and ink in the portions clogging up is suctioned by the pressure reduction inside the cap.), "wait" (If the inside of the cap with reduced air pressure is suddenly opened, air is suctioned from the nozzles; therefore, one should wait until the pressure becomes close to the atmospheric pressure to prevent this.), "leak" (By making the inside of the cap communicate with the atmosphere, no significant difference of pressure between the inside of the cap and the atmosphere is to be produced when the cap is detached.), "detachment" (The cap is detached from the nozzle surface.), and "wipe" (Surplus ink adhering to the nozzle surface is wiped off.). However, the nozzle surface is still in a state of being in contact with ink even immediately after the suction of ink, and in many cases, a large amount of ink adheres to the nozzle surface, also after the cap is detached from the nozzle surface to make the nozzles open.

Up to this time, it has been disclosed in the publication of the unexamined patent application H7-68766, a technology in which a porous ink absorbing body for absorbing ink is incorporated inside the cap, suction is carried out with the detachment speed of the cap from the ink jet head lowered, and the amount of ink adhering to the nozzle surface is reduced.

However, in this method, there is a problem that a long time is required for the detachment of the cap from the ink jet head, which makes long also the sequence time required for a maintenance operation.

Further, as regards the cap disclosed in the publication of the unexamined patent application H7-68766, because approximately all the part of the inside is occupied by the ink absorption body, a pressure loss is easy to be produced at the time of suction owing to the ink absorption body itself becoming a resistance to the suction.

With the above-mentioned points of problem taken into consideration, the inventors of this invention investigated about it to form the ink absorption body to be thin. However, in that case, at a position in the cap far from its suction opening, that is, at a position close to the end portion in the lengthwise direction of the cap, the suction force is not sufficiently effective. For that reason, bubbles are easy to remain, and it has been found that there is produced a new problem that, when the cap is detached from the ink jet head, ink with bubbles mixed is kept attached to the nozzle surface.

As the result, this brings about a phenomenon that ink containing bubbles existing close to the above-mentioned position far from the suction opening is suctioned from the nozzles owing to a capillary phenomenon and causes a failure of jetting to occur. Therefore, if this method is used in a suction process at a slow detachment speed in such an apparatus as described in the publication of the unexamined patent application H7-68766, it means that an insufficient maintenance operation requiring a long time is carried out, which causes the necessity of carrying out a maintenance operation again; therefore, this increases the amount of waste ink to result in useless consumption of ink.

Further, in recent years, for the purpose of making the speed of ink jet printers and the definition of the recorded image higher, there is a tendency to increase the number of nozzles of ink jet heads.

Therefore, it also results in the caps for suctioning ink becoming longer-sized. As the result, as described above, in the neighborhood of the nozzles located far from the suction opening, there is a higher possibility of bubbles remaining, and the possibility of a failure of jetting also becomes higher in accordance with it.

SUMMARY

It is an object of this invention to solve the above-mentioned problems.

It is another object of this invention to suction ink in the nozzles smoothly.

It is further another object of this invention to actualize that no bubble is left on the nozzle surface when ink in the nozzles is suctioned.

These and other objects are attained by an ink jet printer comprising nozzles for jetting ink; a cap for covering the nozzles, wherein the cap has a suction opening for suctioning ink and an atmosphere-communicating opening communicating with the atmosphere, wherein the cap has two divisional areas, a first area and a second area, obtained by dividing the cap into two parts at a center of the cap, wherein both the suction opening and the atmosphere-communicating opening are located in the first area; and a first ink absorption body provided along the bottom surface inside the cap, the suction opening being covered with the first ink absorption body.

Further, the above-mentioned objects of this invention can be accomplished by an ink jet printer comprising nozzles for jetting ink; a cap for covering the nozzles, wherein the cap has a suction opening for suctioning ink and an atmosphere-communicating opening communicating with the atmosphere, wherein both the suction opening and the atmosphere-communicating opening are located in the neighborhood of the cap's one end portion in the lengthwise direction of the cap; and an ink absorption body formed inside the cap, the height of the ink absorption body in the area other than the neighborhood of the suction opening being higher than its height in the neighborhood of the suction opening.

The invention itself, together with further objects and attendant advantages, will best be understood by reference to the following detailed description taken in conjunction with the accompanied drawings.

BRIEF DESCRIPTION OF THE DRAWINGS

FIG. 4(*a*), FIG. 4(*b*), and FIG. 4(*c*) are schematic drawings each showing a state in a cap during the suctioning of ink;

In the following description, like parts are designated by like reference numbers throughout the several drawings.

DESCRIPTION OF THE PREFERRED EMBODIMENT

In the following, examples of the embodiment of this invention will be explained with reference to the drawings.

Figure 1:
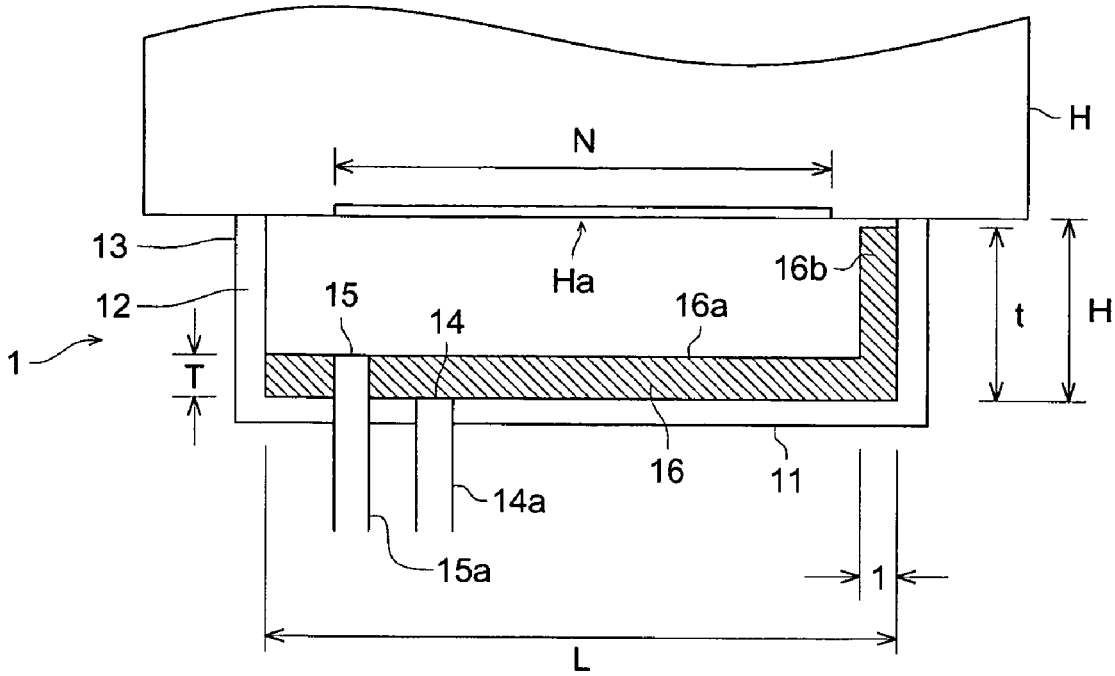
FIG. 1 is a cross-sectional view showing a part of a cap and a head.
Figure 2:
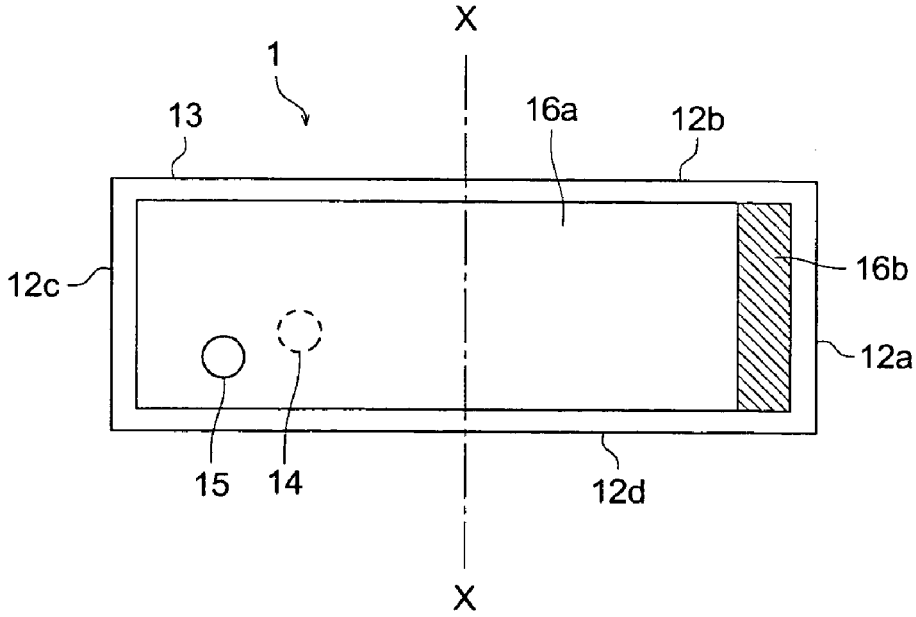
FIG. 2 is the plan of a cap.

FIG. 1 is a cross-sectional view showing a part of a cap 1 and an ink jet head H (hereinafter referred to as a head simply) of this invention. In this drawing, a state in which the cap 1 is in close contact with the nozzle surface of the head H is shown. Further, FIG. 2 is the plan of the cap 1.

The cap 1 is in close contact with the nozzle surface Ha of the head H having nozzles for jetting ink drops, and a cap wall 13 composed of a bottom portion 11 and a side wall portion 12 forming the inside space is formed of an elastic member such as rubber as a whole like a vessel. In this drawing, the cap wall 13 having an approximately rectangular-solid shape is shown with its side wall portions 12*a* to 12*d* provided as standing on the periphery of the approximately rectangular bottom portion 11; however, the shape is not limited to a particular one so long as the cap wall 13 is capable of becoming in close contact with the nozzle surface Ha of the head H for suctioning ink.

In FIG. 1, N denotes the formation range of the nozzles formed on the nozzle surface Ha of the head H, and the cap wall 13 is formed to have a size larger than the length of this formation range of the nozzles N, in order that it may seal hermetically the nozzle surface Ha over a range a little larger than the formation range of the nozzles N in this head H.

At the bottom portion 11 of the cap 1, a suction opening 14 is formed to become open at its lower surface, and an atmosphere-communicating opening 15 is formed to penetrate through the bottom wall. The suction opening 14 communicates with a suction means such as a pump (not shown in the drawing) through a suction pipe 14*a*. The air inside the cap wall 13 is suctioned through the suction opening 14, and ink is suctioned from each of the nozzles of the head H. Further, the atmosphere-communicating opening 15 communicates with an atmosphere-opening valve (not shown in the drawing) through an atmosphere-communicating pipe 15*a*. By suctioning the air inside the cap wall 13 through the suction opening 14 with the atmosphere-opening valve closed, it is possible to make the pressure inside the cap wall 13 negative, to suction ink from each of the nozzles of the head H. On the other hand, with the atmosphere-opening valve opened, the inside of the cap wall 13 is opened to the atmosphere through the atmosphere-communicating pipe 15*a*.

As shown in the drawing, these suction opening 14 and atmosphere-communicating opening 15 are disposed together in the neighborhood of one end portion 13 of the cap wall 13 in the lengthwise direction inside it. In the above description, the term "the neighborhood of one end portion (or the neighborhood of the other end portion) of the cap wall 13" means a position deviated from the line X—X (refer to FIG. 2) connecting the central points of the longer sides 12*b* and 12*d* of the bottom portion 11 of the cap wall 13 toward one of the shorter sides, in other words, toward the side 12*a* or 12*c*.

The atmosphere-communicating opening 15 is provided at a position further deviated toward the side wall portion 12 as compared to the suction opening 14. It is also appropriate to provide the atmosphere-communicating opening at the side wall portion 12.

Of course, for the convenience of explanation, an approximately rectangular bottom portion is used in this example, but the essential point is that the above-mentioned term means a position in the neighborhood of one end portion or the other end portion of the cap wall in the direction of the longer dimension of its shape; generally speaking, it means a position deviated from the central line with respect to the length of the cap wall in the direction perpendicular to the main scanning direction by the carriage (sub-scanning direction) toward the end portion. In FIG. 1 and FIG. 2, the one end portion in the lengthwise direction denotes the left end portion in the drawing, and the other end portion in the lengthwise direction denotes the right end portion in the drawing.

Inside the cap wall 13 of the cap 1, an ink absorption body 16 is provided. For the ink absorption body 16, any one may be used so long as it is a material capable of absorbing ink and capable of discharging the absorbed ink by the suction from the suction opening 14. For example, it is possible to use a porous material formed of a foamed synthetic resin or the like, to be concrete, Bell-eta (trade-name) produced by Kanebo, Ltd.

The ink absorption body 16 is formed over the whole surface of the bottom portion 11 inside the cap wall 13, with its height in the nozzle direction at the other end portion of the bottom portion 11 in the lengthwise direction made higher than that at the one end portion in the lengthwise direction. By this, it is actualized that the portion of the ink absorption body 16 formed at the other end portion in the lengthwise direction mentioned above becomes close to the nozzle surface Ha when the cap 1 is brought into tight contact with the nozzle surface Ha. In the above statement, the term "height in the nozzle direction" means the distance from the surface of the bottom portion 11 in the plane perpendicular to the bottom portion 11.

As regards this height from the bottom portion 11 in the nozzle direction t of that portion of the ink absorption body 16 which is formed at the other end portion of the cap wall 13 in the lengthwise direction, assuming that the height from the bottom portion 11 in the nozzle direction of the neighboring side wall portion 12*a* is denoted by H, with a desirable bubble removal effect taken into consideration, it is desirable that the height t satisfies the inequality (½) H≦t<H. Especially in cases where the height is less than the lower limit, although the bubble removal effect is excellent, the amount of ink to be contained in the ink absorption body becomes small; therefore, in the case where the ink jet head is not used for a long period of time with the nozzle surface covered by the cap, it is produced a problem that the nozzle surface gets dried, and the ink in the nozzles is also dried and fixed as solidified. Further, if the height exceeds the upper limit, because the possibility of the ink absorption body colliding with the nozzle surface becomes higher; this tends to become a cause of a trouble.

That portion of the ink absorption body 16 which is formed at the other end portion in the lengthwise direction of the cap wall 13 represents a standing portion 16*b* rising upward from the bottom portion 11 along the surface of the side wall portion 12*a* at the other end portion in the lengthwise direction, which makes the height of this portion in the nozzle direction higher than the other portion.

Because this standing portion 16*b* is formed in such a manner as to fold upward the end portion of the ink absorption body 16 formed along the bottom portion 11 of the cap wall 13, it has an advantage that it can be easily formed by merely folding the end portion of the ink absorption body 16 having a shape of a belt into an L-shape.

In another way, it is also appropriate to form the bottom portion 16*a* of the ink absorption body 16 lying along the bottom portion 11 of the cap wall 13 and the standing portion 16*b* rising along the surface of the side wall portion 12 as independent separate members. That is, it is also appropriate to provide the standing portion 16*b*, which has been separately formed of an ink absorption material, as located along the surface of the side wall portion 12*a* at the other end portion of the bottom portion 11 of the cap wall 13, where the bottom portion 16*a* of the ink absorption body 16 is provided. In this case, there are advantages such that the thickness of the ink absorption body can be made different between the bottom portion 16*a* and the standing portion 16*b*, that both the portions can be formed of different ink absorption materials, etc. to make it possible to raise the degree of freedom in the design of the ink absorption body 16.

Further, the amount of the projection of that portion of the ink absorption body 16 which is formed at the other end portion of the cap wall 13 in the lengthwise direction into the inside of the cap wall 13 (the thickness of the standing portion 16*b*) is made to be of a degree not to reach the nozzle formation range N of the head H.

Besides, as shown in the drawing, the bottom portion 16*a* of the ink absorption body 16 is provided in such a manner as to cover the suction opening 14, while the atmosphere-communicating opening 15 is formed in such a way as to face the inside of the cap wall 13, and communicates with the atmosphere-communicating pipe 15*a* through the bottom portion 16*a* of the ink absorption body 16.

Figure 3:
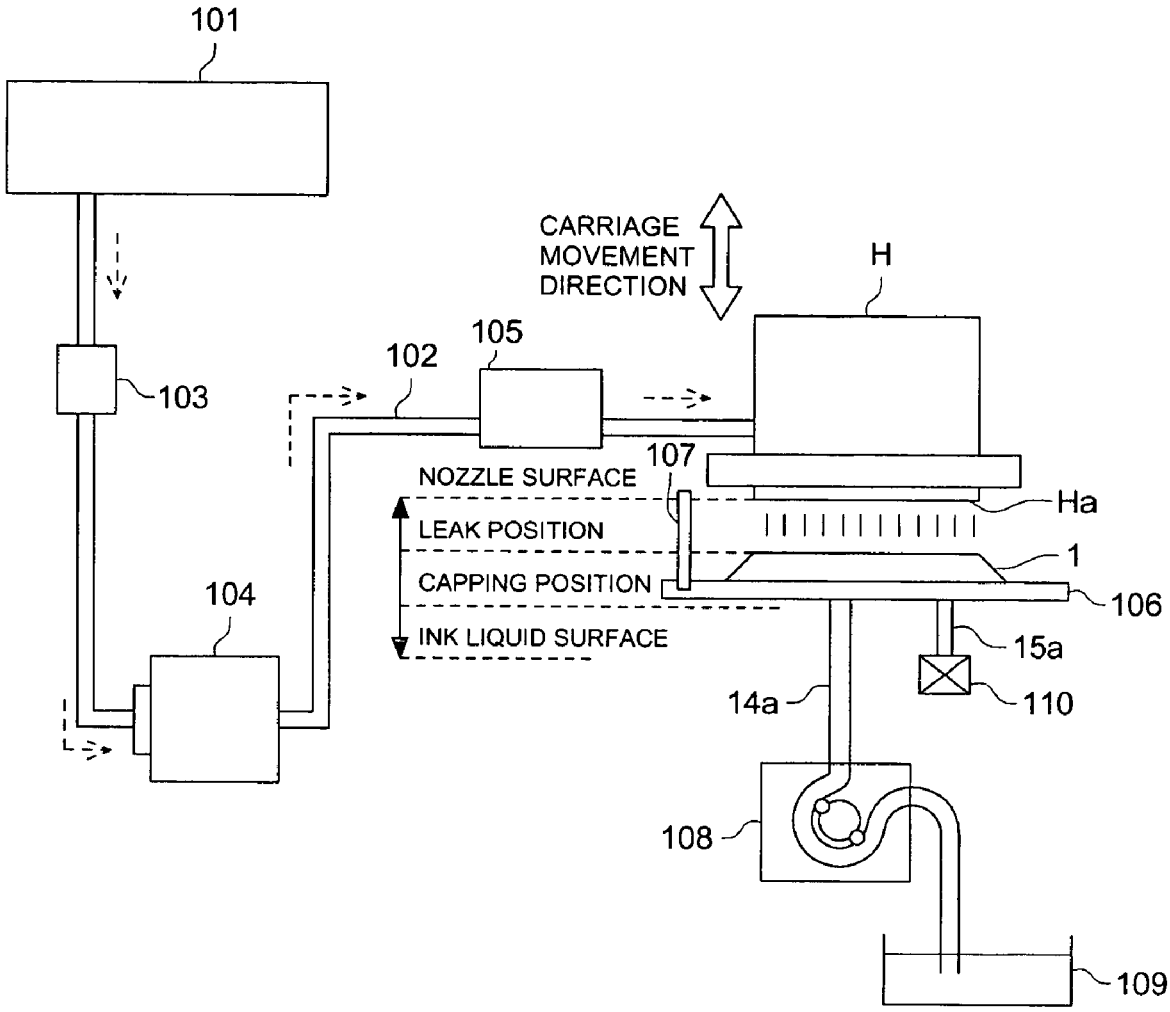
FIG. 3 is a schematic drawing showing an example of an ink jet printer equipped with a cap.

FIG. 3 is a schematic drawing showing an example of an ink jet printer 100 equipped with the above-mentioned cap 1.

The head H is installed on a carriage (not shown in the drawing). The carriage is provided in such a way that it is capable of making an reciprocating movement along the main scanning direction and moving along the vertical direction shown in FIG. 3 in this case. By the reciprocating movement along the main scanning direction of this carriage, the head H is caused to reciprocate along the main scanning direction, and it carries out image recording by jetting ink drops in the process of movement. Further, by the movement of the carriage along the vertical direction, as will be described later, the operation to make the head H become in tight contact with and detach from the cap 1 is carried out.

To this head H, ink is supplied from a main tank 101 having ink stored in a form of an ink-pack through an ink supply pipe 102. Between this main tank 101 and the head H, there are arranged an ink supply valve 103, an intermediate tank 104, and a damper 105 in this order from the upstream side.

The ink supply valve 103 is a valve made up to be capable of electrically opening and closing like an electromagnetic valve for example, and adjusts the amount of ink to be supplied from the main tank 101 to the intermediate tank 104.

The intermediate tank 104 stores temporarily the ink to be supplied from the main tank 101 to the head H. It is actualized that a definite amount of ink is always stored in this intermediate tank 104 by-the detection of the amount of ink by means of an intermediate tank sensor (not shown in the drawing) and the opening/closing control of the above-mentioned ink supply valve 103, and the pressure of ink to be supplied to the head H is kept constant irrespective of the residual amount of ink in the main tank 101.

The damper 105 attenuates and buffers the variation of ink pressure owing to the expansion and contraction of the tube accompanied by the reciprocating movement of the head H along the main scanning direction and the acceleration and deceleration of ink in the tube.

The cap 1 is placed on a support table 106 with the open side of its cap wall 13 made to face the nozzle surface Ha of the head H. Further, on the same support table 106 for the cap 1, there is provided as standing, a blade 107 formed of a material having elasticity such as rubber for cleaning the nozzle surface Ha of the head H.

The suction pipe 14*a* communicating with the suction opening 14 of the cap 1 is connected with a suction pump 108 as a suction means. Ink suctioned by the suction pump 108 (hereinafter referred to as waste ink) is discharged to a waste ink tank 109.

Further, one end of the atmosphere-communicating pipe 15*a* communicates with the atmosphere-communicating opening 15 of the cap 1 with the other end of it opened, and a valve 110 is placed at a specified interval from it. The support table 106 is urged toward the nozzle surface Ha of the head H by an urging spring (not shown in the drawing) During a normal time the cap wall 13 is not in contact with the nozzle surface Ha, the other end of the atmosphere-communicating pipe 15*a* is detached from the valve 110. However, when the cap 1 is pressed down against the urging spring force by the nozzle surface Ha of the descending head H getting in contact with the cap 1 (leak position) and further moving down, the other end of the atmosphere-communicating pipe 15*a* is brought into contact with the valve 110 to become closed, to hermetically seal the inside of the cap wall 13 of the cap 1 (capping position). Accordingly, of this valve 110, an atmosphere opening/closing valve is made up.

Figure 5:
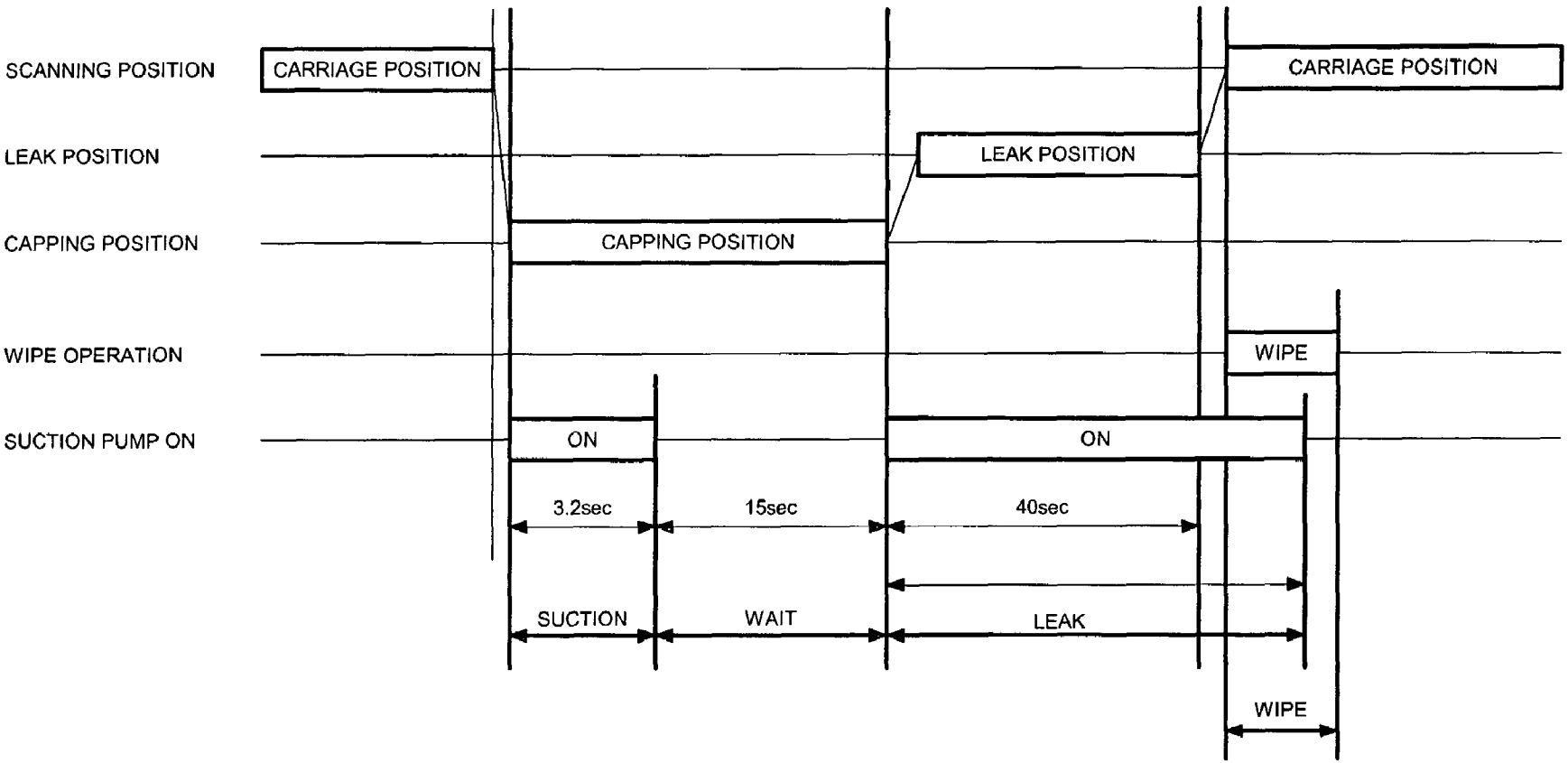
FIG. 5 is a drawing showing the sequence at the time of suctioning ink.

Next, the operation at the time ink suction is carried out from the head H by the above-mentioned cap 1 will be explained with reference to FIG. 4 and FIG. 5. FIG. 4(*a*) to FIG. 4(*c*) are schematic drawings each showing a state in the cap 1 at the time of ink suction, and FIG. 5 is a drawing showing the sequence at the time of ink suction.

When the carriage moves to the position where the cap 1 is placed, it starts descending, and accompanied by it, the nozzle surface Ha of the head H moves down from the position where image recording is carried out (the carriage position) through the leak position, further up to the capping position. By this movement, the atmosphere-communicating pipe 15*a* is closed by the valve 110, and the inside of the cap wall 13 of the cap 1 is hermetically sealed to have its communication with the atmosphere intercepted.

Simultaneously with this, the suction pump 108 is actuated to suction the air inside the cap wall 13 through the suction pipe 14*a* from the suction opening 14 through the ink absorption body 16. As the result, when the air pressure of the inside of this cap wall 13 becomes negative, ink is suctioned from each of the nozzles of the head H to the inside of the cap wall 13. By this, as shown in FIG. 4(*a*), the suctioned waste ink "A" is stored inside the cap wall 13. The suction time in this process is determined to be 3.2 sec.

A large number of bubbles "a" are contained in this waste ink "A".

When the waste ink "A" of a specified amount is suctioned and stored in the cap wall 13, the operation of the suction means is temporarily stopped, and the state of this stopping is continued for a specified time. The wait time is determined to be 15 sec. in this example.

After this wait time, the carriage is moved upward until the nozzle surface Ha of the head H reaches the leak position. By this, the other end of the atmosphere-communicating pipe 15*a* is detached from the valve 110 to become opened by the support table being moved upward by the urging force of the urging spring. By this, air flows into the cap wall 13 through the communicating pipe 15*a* from the atmosphere-communicating opening 15, resulting in the inside of the cap wall 13 being open to the atmosphere. Now, the suction pump 108 resumes the operation, to suction the waste ink "A" stored inside the cap wall 13 from the suction opening 14.

At this time, because both the suction opening 14 and the atmosphere-communicating opening 15 are located in the neighborhood of the one end portion in the lengthwise direction inside the cap wall 13, the air flow from the atmosphere-communicating opening 15 through the inside of the cap wall 13 up to the suction opening (flow path of ink) is formed in such a way as shown by the dotted line in FIG. 4(*b*). That is, in the neighborhood of the other end portion in the lengthwise direction farthest from the suction opening 14 and the atmosphere-communicating opening 15, the standing portion 16*b* of the ink absorption body 16 having the higher height in the nozzle direction is formed; therefore, the air having flowed in from the atmosphere-communicating opening 15 is suctioned from the inside of the cap wall through the standing portion 16*b* located at the farthest position from the suction opening 14 and the atmosphere-communicating opening 15 and the bottom portion 16*a* of the ink absorption body 16 to the suction opening 14. Accordingly, the waste ink "A" in the cap wall 13 is suctioned from the inside of the cap wall 13 through the standing portion 16*b* located at the farthest position from the suction opening 14 and the atmosphere-communicating opening 15 and the bottom portion 16*a* of the ink absorption body 16 to the suction opening 14.

Because an ink flow speed is slow in the neighborhood where is the farthest place from the suction opening 14, the bubbles "a" get together in the neighborhood of the other end portion in the lengthwise direction (the neighborhood of the right end portion) which is the farthest place from the suction opening 14. The bubbles "a" in the neighborhood where is the farthest place from the suction opening 14 do not go through the ink absorption body 16. As the result, those bubbles "a" remain on the standing portion 16*b* of the ink absorption body 16. Therefore, those bubbles "a" are not kept attached to the nozzles.

After that, for example, after 40 seconds have passed, the carriage ascends up to the carriage position again, and as shown in FIG. 4(*c*), the cap 1 is detached from the nozzle surface Ha of the head H. Also during this time, suction by the suction pump 108 is continued. At this time, bubbles "a" in the waste ink "A" collected at the position farthest from the suction opening 14 and the atmosphere-communicating opening 15 inside the cap wall 13 becomes easy to vanish due to contact with the standing portion 16*b* of the ink absorption body 16, and further, they are removed by the suction from this standing portion 16*b*; thus, it never occurs that bubbles are left as attached to the nozzle surface Ha at the time of detachment.

After the carriage has ascended up to the carriage position, by the movement of the support table 106 along the array direction of the nozzles of the head H, a blade 107 provided as standing on the support table 106 cleans (wipes) the nozzle surface Ha. In this example, also after the carriage started ascending toward the carriage position, the suctioning by the suction pump 108 was continued for ten seconds, and the suction for the waste ink "A" was carried out up to the halfway of the cleaning by the blade 107.

At this time, because the nozzle surface Ha has no bubbles "a" in the waste ink "A" attached thereto as described above, it never occurs that the waste ink. "A" attached to the blade 107 in a large amount is scattered by the restoring force of the blade 107 to smudge the surrounding area. In a conventional technology, it has been necessary to separately provide an ink absorption body for collecting the waste ink scattered by the restoring force of this blade 107, but by this invention, it is unnecessary to separately provide such an ink absorption body.

In this example of the embodiment, it is important at least that the ink absorption body to be provided inside the cap wall 13 of the cap 1 is formed to have its height in the nozzle direction in the neighborhood of the other end portion in the lengthwise direction farthest from the suction opening 14 and the atmosphere-communicating opening 15 made higher than its height in the nozzle direction in the neighborhood of the one end portion in the lengthwise direction where the suction opening 14 and the atmosphere-communicating opening 15 are formed. In the example of the embodiment shown in FIG. 1 and FIG. 2, one having the standing portion 16*b* formed at the other end portion farthest from the suction opening 14 and the atmosphere-communicating opening 15 in the ink absorption body 16 is shown, but this invention is not limited to this example.

Figure 6:
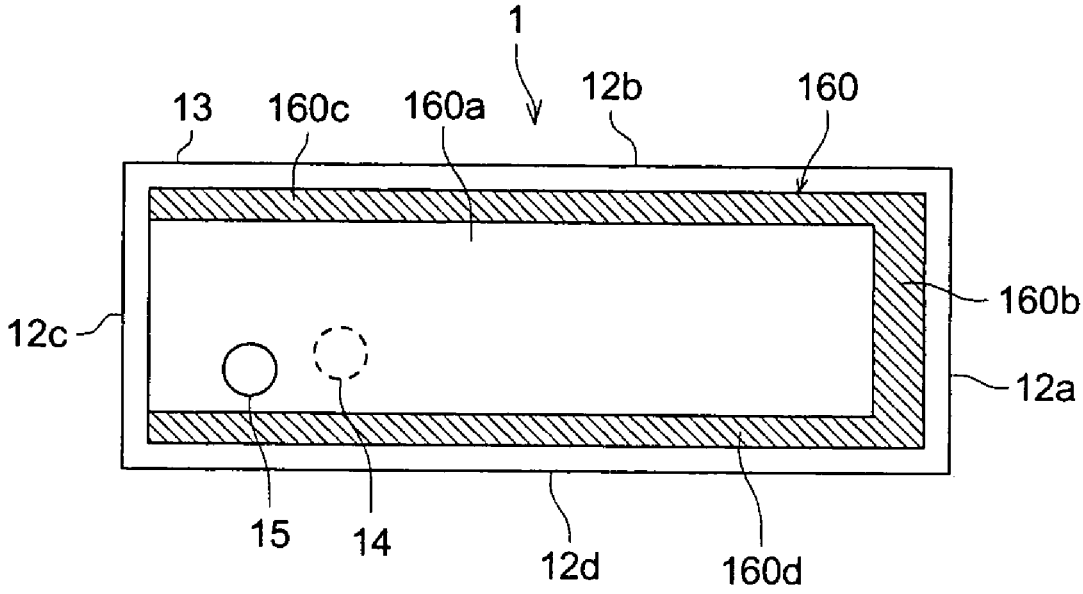
FIG. 6 is the plan of a cap containing an ink absorption body of another example of the embodiment.
Figure 7:
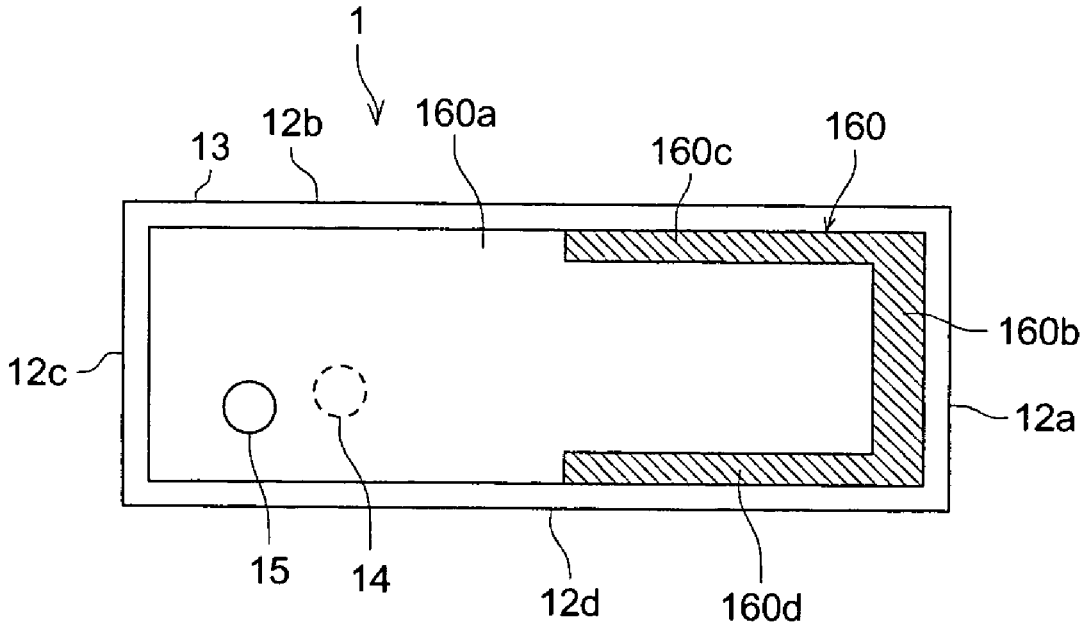
FIG. 7 is the plan of a cap containing an ink absorption body of another example of the embodiment.
Figure 8:
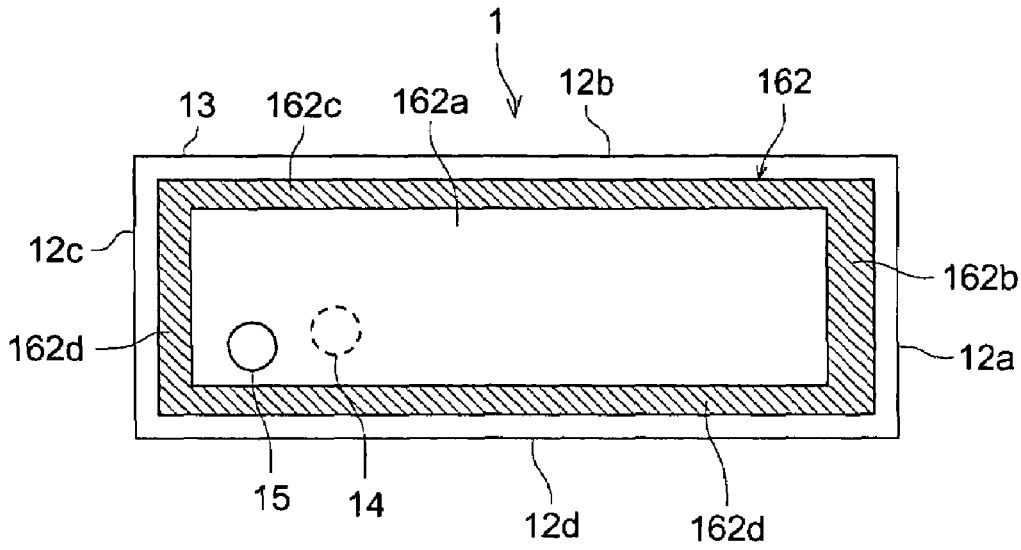
FIG. 8 is the plan of a cap containing an ink absorption body of another example of the embodiment.

FIG. 6 to FIG. 8 are the plans of caps 1 for suctioning ink containing their respective ink absorption bodies 160 to 162 of another examples of practice.

The ink absorption body 160 has its bottom portion 160*a* lying along the bottom portion 11 of the cap wall 13, and the standing portions 160*b* to 160*d* which are formed as standing along the surface of all the side walls 12*a*, 12*b*, and 12*d* respectively, except for the side wall 12*c* at the shorter side of the above-mentioned bottom portion 11 which is the one end portion in the lengthwise direction of the cap wall 13.

By forming the ink absorption body 160 in this way, it is possible to suction waste ink containing bubbles at the positions, where bubbles tend to get together, far from the suction opening 14 and the atmosphere-communicating opening 15, from the three directions of the standing portions 160*b* to 160*d* formed to have a higher height in the nozzle direction; therefore, it is possible to make higher the suction-removal effect of bubbles.

Further, because the inner volume of the cap wall 13 of the cap 1 is made smaller by the standing portions 160*b* to 160*d*, it is possible to make smaller suction force for suctioning ink from each of the nozzles of the head H; thus, it is possible to achieve it to make the suction means small-sized and the cost reduction of the power for suctioning.

The ink absorption body 161 shown in FIG. 7 has a bottom portion 161*a* and a standing portion 161*b* similar to the bottom portion 160*a* and the standing portion 160*b* shown in FIG. 6, and a standing portions 161*c* and 161*d* formed with their approximately half part in the area containing the suction opening 14 and the atmosphere-communicating opening 15 removed. By this, it is possible to reduce the volume of the ink absorption body used, while the suction-removal effect of bubbles "a" can be made higher in the same way as the above-mentioned.

The ink absorption body 162 shown in FIG. 8 has a bottom portion 162*a* lying along the bottom portion 11 of the cap wall 13, and standing portions 162*b* to 162*e* formed as standing along the surface of the side walls 12*a* to 12*d* surrounding the periphery of the bottom portion 11 of the cap wall 13 respectively. By this, it is possible to make the space inside the cap wall 13 substantially smallest, and because the area where ink is brought into contact with the ink absorption body. 162 becomes larger, the effect of vanishing bubbles is high, and it is possible to make the suction-removal effect of bubbles much higher.

As regards these ink absorption bodies 160, 161, and 162, it is appropriate to form, in the same way as the ink absorption body 16 shown in FIG. 1 and FIG. 2, the standing portions 160*b* to 160*d*, 161*b* to 161*d*, and 162*b* to 162*e* each as a unified body by folding upward the end portion of the bottom portions 160*a*, 161*a*, and 162*a* lying along the bottom portion 11 of the cap wall 13, or also it is appropriate to form them as members that are separate from their respective bottom portions 160*a*, 161*a*, and 162*a*.

Figure 9:
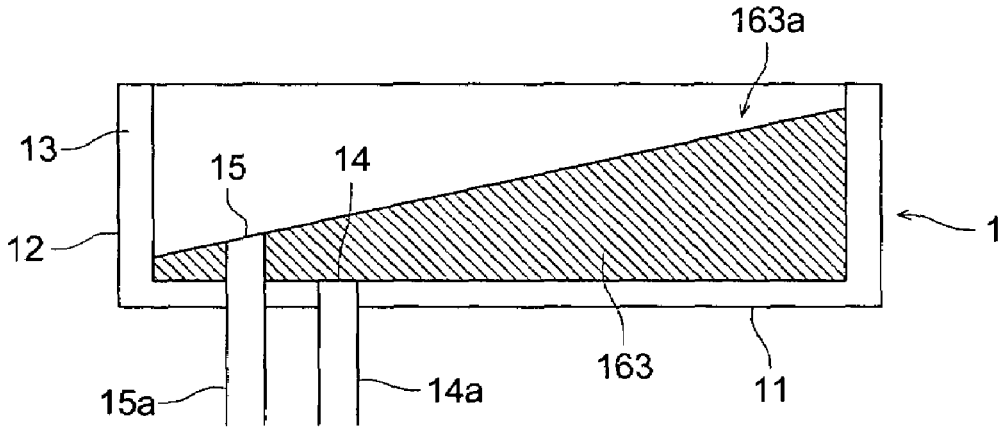
FIG. 9 is a cross-sectional view of a cap containing an ink absorption body of another example of the embodiment.

FIG. 9 is a cross-sectional view of a cap 1 containing an ink absorption body 163 of another example of the embodiment. This ink absorption body 163 is formed in such a manner as to have its height in the nozzle direction gradually raised from the one end (left end in the drawing) in the lengthwise direction, in the neighborhood of which the suction opening 14 and the atmosphere-communicating opening 15 are provided, toward the other end (right end in the drawing) farthest from the suction opening 14 and the atmosphere-communicating opening 15. Accordingly, in this ink absorption body 163, the other end portion 163*a* farthest from the suction opening 14 and the atmosphere-communicating opening 15 is closer to the nozzle surface Ha of the head H than the portion in the neighborhood of the suction opening 14 and the atmosphere-communicating opening 15.

By this example of the embodiment, because the distance between the ink absorption body and the nozzle surface Ha becomes smaller in accordance with the position becoming farther from the suction opening 14, it is possible to make the flow speed of ink at the time of suctioning ink higher in accordance with the position becoming farther from the suction opening 14; owing to this, it is possible to make more satisfactory the vanishing of bubbles in the waste ink.

When any one of the standing portions 16*b*, 160*b* to 160*d*, 161*b* to 161*d*, and 162*b* to 162*e* of their respective ink absorption bodies 16, 160, 161, and 162 shown in FIG. 1 and FIG. 2, and FIG. 6 to FIG. 8 is formed by folding upward and the one of the ink absorption bodies is fitted in the cap 1, it is appropriate that a plurality of projections (not shown in the drawing) provided on the side wall portion 12 of the cap 1 for holding the ink absorption body 16, 160, 161, or 162 to be provided in the cap wall 13 engage with engagement holes provided in such a way as to engage with the projections to fix the ink absorption body.

Figure 10:
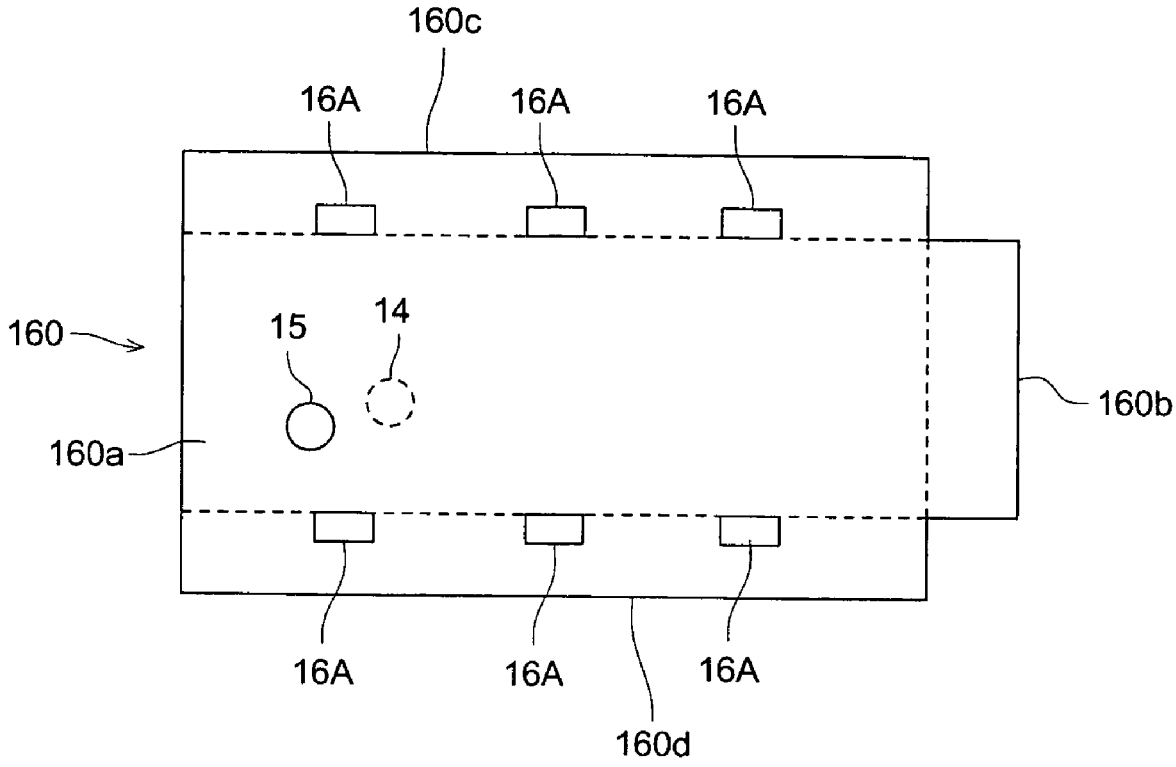
FIG. 10 is the plan showing a cap containing an ink absorption body of another example of the embodiment in the developed state.

An example of the engagement holes is shown in FIG. 10. FIG. 10 shows a developed view of the ink absorption body 160 shown in FIG. 6 in the case of standing portions 160*b* to 160*d* being formed by folding. Engagement holes 16A are formed as opened in the neighborhood of the fold lines in the standing portions 160*b* to 160*d* except for the bottom portion 160*a*. By the engagement of these engagement holes 16A and the projections formed on the side wall portion 12, it is possible to hold the ink absorption body 160 in the cap wall 13 in a simple way. Further, as regards other ink absorption bodies 161 and 162 too, the engagement holes 16A can be formed in the same way.

Further, in the case where the ink absorption body 163 shown in FIG. 9 is held inside the cap wall 13, it is appropriate to form engagement concavities to be capable of engaging with the above-mentioned projections on the side surface of the ink absorption body 163.

By these examples of the embodiment, it is possible to provide an ink jet printer capable of suctioning out bubbles in the ink suctioned from the nozzle surface of an ink jet head from the inside of the cap with a high efficiency without leaving bubbles remaining on the nozzle surface.

Although the present invention has been fully described by way of examples with reference to the accompanied drawings, it is to be noted that various changes and modifications will be apparent to those skilled in the art. Therefore, unless such changes and modifications depart from the scope of the present invention, they should be construed as being included therein.

What is claimed is:

1. An ink jet printer comprising:

nozzles for jetting ink;

a cap for covering the nozzles, wherein the cap has a suction opening for suctioning ink and an atmosphere-communicating opening communicating with the atmosphere, wherein the cap has two divisional areas, a first area and a second area, obtained by dividing the cap into two parts at a center of the cap, wherein both the suction opening and the atmosphere-communicating opening are located in the first area; and a first ink absorption body provided along a bottom surface inside the cap, the suction opening being covered with the first ink absorption body.

2. An ink jet printer of claim 1, wherein the atmosphere-communicating opening is not covered with the first ink absorption body.

3. An ink jet printer of claim 1, further comprising:

a second ink absorption body provided along an inner surface of the side wall of the cap located in the second area, the second ink absorption body being formed to be higher than the first ink absorption body.

4. An ink jet printer of claim 3, wherein the first ink absorption body and second ink absorption body being formed as a unified body.

5. An ink jet printer of claim 3, further comprising:

a second ink absorption body provided along the inner surface of the side walls of the cap common to the first area and second area.

6. An ink jet printer of claim 1, wherein the atmosphere-communicating opening being located at a position farther from the second area than the suction opening.

7. An ink jet printer of claim 1, wherein the first ink absorption body has its height made gradually lower from the second area side toward the first area side.

8. An ink jet printer of claim 1, wherein the side walls of the cap are made of an elastic member.

9. An ink jet printer comprising:

nozzles for jetting ink;

a cap for covering the nozzles, wherein the cap has a suction opening for suctioning ink and an atmosphere-communicating opening communicating with the atmosphere, wherein both the suction opening and the atmosphere-communicating opening are located in a neighborhood of the cap's one end portion in the lengthwise direction of the cap; and an ink absorption body formed inside the cap, a height of the ink absorption body in the area other than the neighborhood of the suction opening being higher than its height in the neighborhood of the suction opening.

10. An ink jet printer of claim 9, wherein the ink absorption body is provided along a bottom surface of the cap.

11. An ink jet printer of claim 10, wherein the suction opening is provided in the bottom of the cap.

12. An ink jet printer of claim 11, wherein the suction opening is covered with the ink absorption body.

13. An ink jet printer of claim 10, wherein the atmosphere-communicating opening is provided in the bottom of the cap.

14. An ink jet printer of claim 13, wherein the atmosphere-communicating opening is not covered with the ink absorption body.

15. An ink jet printer of claim 9, wherein the atmosphere-communicating opening is provided at a position deviated from the suction opening toward the end portion in the lengthwise direction.

16. An ink jet printer of claim 9, wherein the ink absorption body is further provided also along an inner surface of a side wall of the cap at an other end in the lengthwise direction.

17. An ink jet printer of claim 16, wherein the height t of the ink absorption body provided along the inner surface of the side wall of the cap at the other end of it in the lengthwise direction satisfies the following inequality:

$$(1/2)\times H \leqq t < H,$$

where H denotes the height of the side wall of the cap.

18. An ink jet printer of claim 9, wherein the ink absorption body has its height made gradually higher toward an other end portion of the cap in the lengthwise direction opposite to the suction opening.

19. An ink jet printer of claim 9, further comprising:

a suction means for generating a suction force to suction ink from the suction opening.

20. An ink jet printer of claim 9, wherein side walls of the cap are made of an elastic member.

* * * * *